US012044433B2

(12) United States Patent
Horie

(10) Patent No.: US 12,044,433 B2
(45) Date of Patent: Jul. 23, 2024

(54) AIR-CONDITIONING APPARATUS

(71) Applicant: Mitsubishi Electric Corporation, Tokyo (JP)

(72) Inventor: Ryo Horie, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 519 days.

(21) Appl. No.: 17/423,168

(22) PCT Filed: Mar. 20, 2019

(86) PCT No.: PCT/JP2019/011732
§ 371 (c)(1),
(2) Date: Jul. 15, 2021

(87) PCT Pub. No.: WO2020/188793
PCT Pub. Date: Sep. 24, 2020

(65) Prior Publication Data
US 2022/0128265 A1 Apr. 28, 2022

(51) Int. Cl.
*F24F 13/22* (2006.01)

(52) U.S. Cl.
CPC ..... *F24F 13/22* (2013.01)

(58) Field of Classification Search
CPC .... F24F 13/22; F24F 2013/221; F24F 1/0047; F24F 1/0059
USPC ..... 62/291
See application file for complete search history.

(56) References Cited

U.S. PATENT DOCUMENTS 3,524,328 A * 8/1970 Schuster ..... F24F 1/035 165/122
3,596,475 A * 8/1971 Berger ..... F24F 13/222 62/286
4,898,003 A * 2/1990 Ichikawa ..... B60H 1/3229 165/122
(Continued)

FOREIGN PATENT DOCUMENTS

EP 1806541 A1 7/2007
JP S59-013917 U 1/1984
(Continued)

OTHER PUBLICATIONS

International Search Report of the International Searching Authority mailed Apr. 23, 2019 for the corresponding International application No. PCT/JP2019/011732 (and English translation).
(Continued)

*Primary Examiner* — Tho V Duong
(74) *Attorney, Agent, or Firm* — Posz Law Group, PLC

(57) ABSTRACT

An air-conditioning apparatus includes a casing; a heat exchanger disposed in the casing; a sirocco fan disposed in the casing and located upstream of the heat exchanger along a flow passage such that an air outlet of the sirocco fan faces the heat exchanger; a drain pan disposed in the casing and located below the heat exchanger, the drain pan receiving drain water generated in the heat exchanger; and a dew-scattering-reducing part that reduces scattering of the drain water. The dew-scattering-reducing part is disposed outside a region enclosed by extension lines from the air outlet toward the heat exchanger and inside the drain pan.

9 Claims, 7 Drawing Sheets

(56) References Cited

U.S. PATENT DOCUMENTS

| | | | | |
|---|---|---|---|---|
| 5,199,276 | A * | 4/1993 | Sullivan | F24F 13/22 220/571 |
| 6,474,092 | B2 * | 11/2002 | Davis | F04D 29/4226 62/426 |
| 7,604,043 | B2 * | 10/2009 | Higashida | F24F 1/0022 165/122 |
| 10,132,554 | B2 * | 11/2018 | Kim | F24F 1/0073 |
| 2010/0206514 | A1 * | 8/2010 | Liu | F24F 1/0047 165/67 |
| 2019/0242612 | A1 | 8/2019 | Teramoto et al. | |

FOREIGN PATENT DOCUMENTS

| | | | |
|---|---|---|---|
| JP | S62-063616 | U | 4/1987 |
| JP | 2009041836 | A | 2/2009 |
| JP | 2010255983 | A | 11/2010 |
| JP | 2011226407 | A | 11/2011 |
| WO | 2005052457 | A1 | 6/2005 |
| WO | 2017203702 | A1 | 11/2017 |
| WO | 2018079776 | A1 | 5/2018 |

OTHER PUBLICATIONS

Extended European Search Report dated Feb. 17, 2022 issued in corresponding European patent application No. 19919860.7.

* cited by examiner

Comparative Example

Comparative Example

AIR-CONDITIONING APPARATUS

CROSS REFERENCE TO RELATED APPLICATION

This application is a U.S. national stage application of PCT/JP2019/011732 filed on Mar. 20, 2019, the contents of which are incorporated herein by reference.

TECHNICAL FIELD

The present disclosure relates to an air-conditioning apparatus.

BACKGROUND ART

Patent Literature 1 describes an indoor unit suspending from the ceiling of a room and conditions air in the room. The indoor unit includes a heat exchanger, sirocco fans, and a drain pan. The sirocco fans suck in air in the room through an air inlet in a casing of the indoor unit. The heat exchanger causes air supplied by the sirocco fans to exchange heat to cool or heat the air. During the heat exchange between air and refrigerant performed by the heat exchanger, moisture in the air is condensed, and drain water droplets fall from the heat exchanger. The drain pan is positioned to catch the drain water droplets that fall from the heat exchanger.

CITATION LIST

Patent Literature

Patent Literature 1: Japanese Unexamined Patent Application Publication No. 2009-41836

SUMMARY OF INVENTION

Technical Problem

The heat exchanger described in Patent Literature 1 is disposed between an air outlet of the casing and air outlets of the sirocco fans. Therefore, drain water generated in the heat exchanger is dispersed by the air blown from the air outlets of the sirocco fans, and a phenomenon called "dew scattering" occurs. As a result, water droplets may be scattered onto components disposed in the indoor unit. In addition, drain water droplets may fall outside the drain pan and accumulate on a bottom surface of the indoor unit, and this may lead to a water leakage. To suppress occurrence of this phenomenon, a surface of the heat exchanger may be covered with a cover to reduce dispersion of the drain water generated in the heat exchanger by the air from the sirocco fans. However, such a cover partially blocks the flow of air from the sirocco fans. Therefore, shaft power of a drive motor for each sirocco fan needs to be increased to maintain the heat exchange efficiency of the heat exchanger.

The present disclosure has been made to solve the above-described problems, and an object of the present disclosure is to provide an air-conditioning apparatus in which scattering of drain water generated in a heat exchanger can be reduced without causing an increase in shaft power of a sirocco fan.

Solution to Problem

An air-conditioning apparatus according to an embodiment of the present disclosure includes a casing; a heat exchanger disposed in the casing; a sirocco fan disposed in the casing and located upstream of the heat exchanger along a flow passage such that an air outlet of the sirocco fan faces the heat exchanger; a drain pan disposed in the casing and located below the heat exchanger, the drain pan receiving drain water generated in the heat exchanger; and a dew-scattering-reducing part that reduces scattering of the drain water. The dew-scattering-reducing part is disposed outside a region enclosed by extension lines from the air outlet toward the heat exchanger and inside the drain pan.

Advantageous Effects of Invention

The air-conditioning apparatus according to the embodiment of the present disclosure is structured such that the dew-scattering-reducing part is disposed outside the region enclosed by the extension lines from the air outlet of the sirocco fan toward the heat exchanger. Therefore, the dew-scattering-reducing part does not block the flow of air blown from the air outlet toward the heat exchanger. Accordingly, the dew-scattering-reducing part is not disposed to cause a reduction in the heat exchange efficiency of the heat exchanger, and shaft power of the sirocco fan does not need to be increased. In addition, the dew-scattering-reducing part is disposed inside the drain pan. Therefore, the dew-scattering-reducing part suppresses scattering of the drain water guided by the flow of air reflected by the heat exchanger toward a region outside the drain pan. Thus, according to the air-conditioning apparatus of the embodiment of the present disclosure, dew scattering of the drain water generated in the heat exchanger can be reduced without causing an increase in shaft power of a drive motor of the sirocco fan.

DESCRIPTION OF EMBODIMENTS

Figure 1:
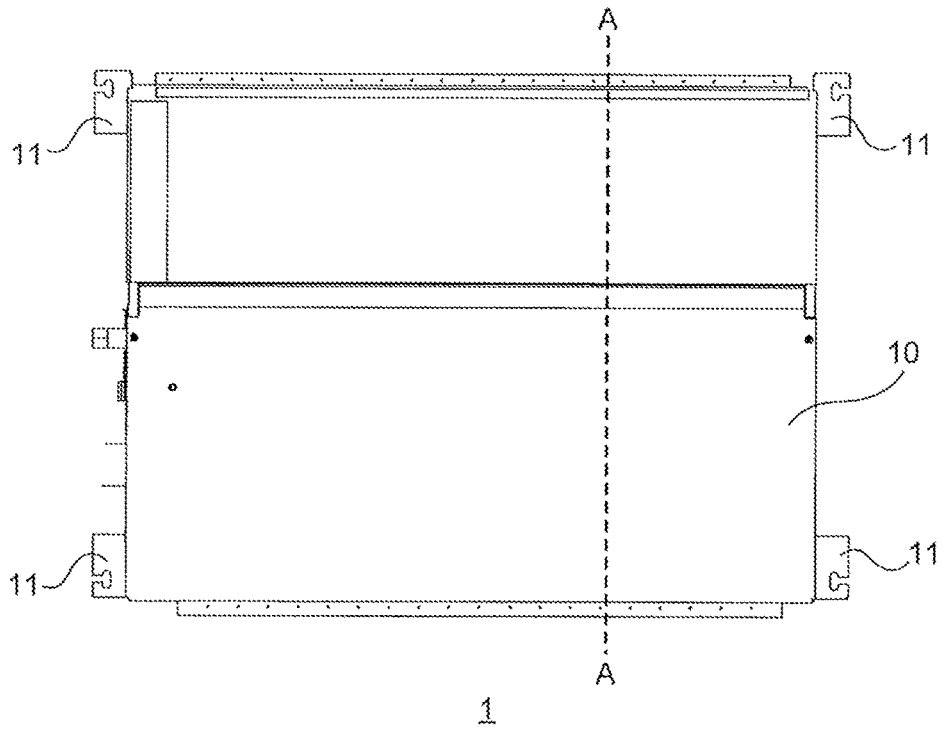
FIG. 1 a plan view of an air-conditioning apparatus according to Embodiment.

An air-conditioning apparatus according to Embodiment will now be described in detail with reference to the drawings. The present disclosure is not limited to Embodiment described below. In the drawings referred to below, sizes and shapes of components may differ from those in an actual apparatus.

Embodiment

FIG. 1 is a plan view of an air-conditioning apparatus according to Embodiment. An air-conditioning apparatus 1 is, for example, an indoor unit installed in the ceiling of a room to be air-conditioned. The air-conditioning apparatus 1 includes a casing 10. The casing 10 is provided with hanging metal pieces 11.

Figure 2:
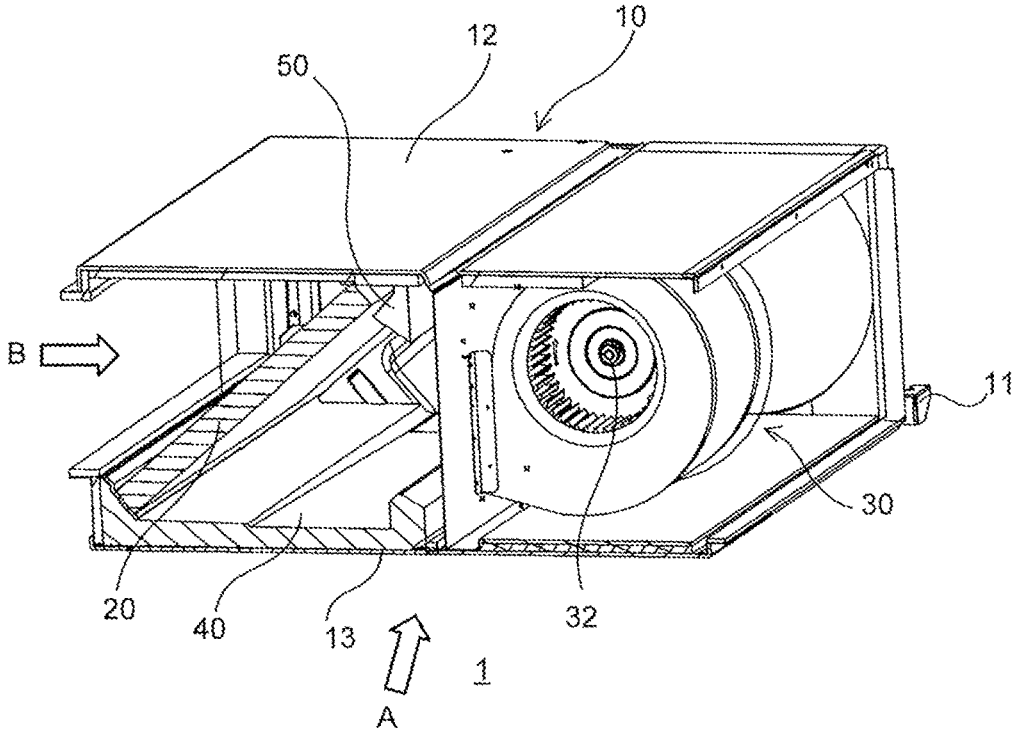
FIG. 2 illustrates the internal structure of the air-conditioning apparatus according to Embodiment.

FIG. 2 illustrates the internal structure of the air-conditioning apparatus according to Embodiment. FIG. 2 illustrates the internal structure of the air-conditioning apparatus 1 sectioned along line A-A in FIG. 1 and viewed from the right in FIG. 1. A heat exchanger 20, a sirocco fan 30, and a drain pan 40 are disposed in the casing 10. In FIG. 2, the sirocco fan 30 is disconnected from a motor, which will be described below. The heat exchanger 20 is inclined in a direction from a top plate 12 of the casing 10 toward a bottom plate 13 of the casing 10 with increasing distance from the sirocco fan 30. The sirocco fan 30 is located upstream of the heat exchanger 20 along a flow passage. The sirocco fan 30 has a shaft hole 32 in which a motor shaft of the motor, which will be described below, is inserted. The sirocco fan 30 is oriented such that a rotational axis thereof extends laterally. In addition, the sirocco fan 30 is disposed such that an air outlet thereof, which will be described below, faces the heat exchanger 20. The drain pan 40 is disposed on the bottom plate 13. The drain pan 40 on the bottom plate 13 is located below the heat exchanger 20. The drain pan 40 is provided to receive drain water generated in the heat exchanger 20. A dew-scattering-reducing part 50 is disposed between the heat exchanger 20 and the sirocco fan 30.

Figure 3:
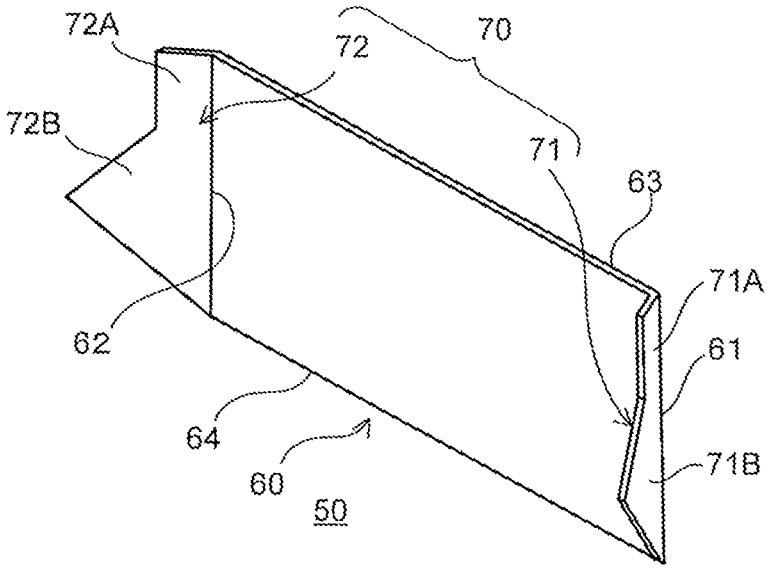
FIG. 3 is a perspective view of a dew-scattering-reducing part according to Embodiment.
Figure 4:
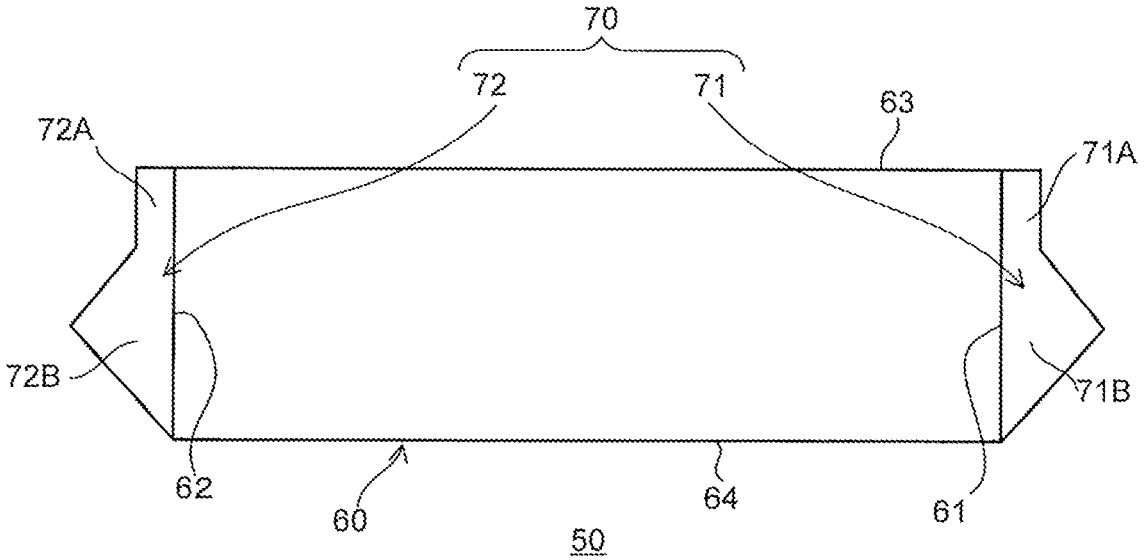
FIG. 4 is a front view of the dew-scattering-reducing part according to Embodiment.
Figure 5:
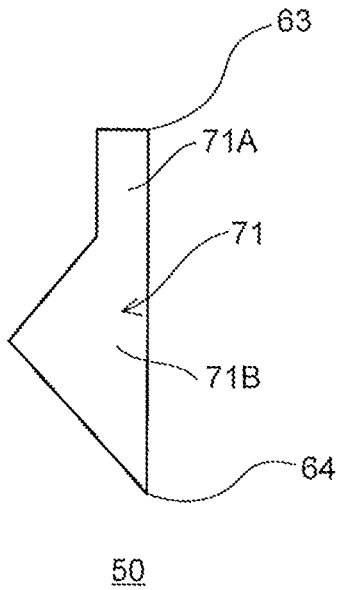
FIG. 5 is a side view of the dew-scattering-reducing part according to Embodiment.
Figure 6:
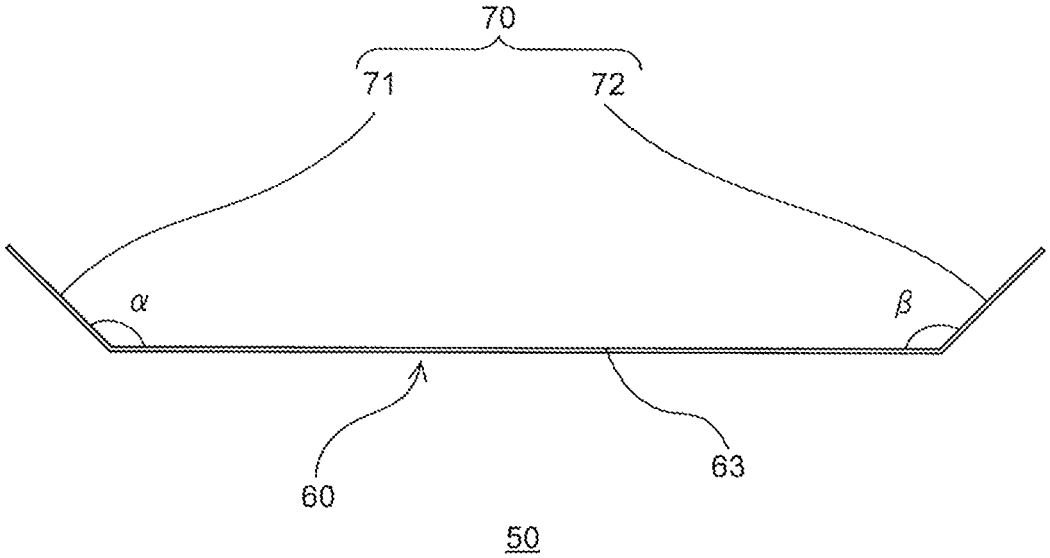
FIG. 6 is a plan view of the dew-scattering-reducing part according to Embodiment.

FIG. 3 is a perspective view of the dew-scattering-reducing part according to Embodiment. FIG. 4 is a front view of the dew-scattering-reducing part according to Embodiment. FIG. 5 is a side view of the dew-scattering-reducing part according to Embodiment. FIG. 6 is a plan view of the dew-scattering-reducing part according to Embodiment. The dew-scattering-reducing part 50 includes a first reducing portion 60 and a second reducing portion 70. The first reducing portion 60 is an elongated thin-plate-shaped part. The second reducing portion 70 includes a projecting plate 71 and a projecting plate 72. The projecting plate 71 is provided on one end portion 61 of the first reducing portion 60 in a longitudinal direction. The projecting plate 72 is provided on the other end portion 62 of the first reducing portion 60 in the longitudinal direction. The projecting plate 71 and the projecting plate 72 are plate-shaped parts that project from the first reducing portion 60 in the same direction that is orthogonal to the first reducing portion 60.

In Embodiment, the projecting plate 71 of the second reducing portion 70 is formed to be continuous with the end portion 61 of the first reducing portion 60, and the projecting plate 72 of the second reducing portion 70 is formed to be continuous with the end portion 62 of the first reducing portion 60. The projecting plate 71 and the projecting plate 72 extend from an upper end portion 63 to a lower end portion 64 of the first reducing portion 60. In Embodiment, the first reducing portion 60 and the second reducing portion 70 are integrated with each other.

In Embodiment, the first reducing portion 60 and each of the projecting plate 71 and the projecting plate 72 of the second reducing portion 70 are made of a metal material.

The projecting plate 71 and the projecting plate 72 are thin plate-shaped parts. The projecting plate 71 includes a base portion 71A that extends in a short-side direction of the first reducing portion 60 and a triangular guide portion 71B formed to be continuous with the base portion 71A. Similarly, the projecting plate 72 includes a base portion 72A that extends in the short-side direction of the first reducing portion 60 and a triangular guide portion 72B formed to be continuous with the base portion 72A. As illustrated in FIG. 6, an angle $\alpha$ between the projecting plate 71 and the first reducing portion 60 is equal to an angle $\beta$ between the projecting plate 72 and the first reducing portion 60. In Embodiment, the angle $\alpha$ and the angle $\beta$ are 135 degrees.

The projecting plate 71 is formed so that, when the first reducing portion 60 is vertically oriented, an upper edge portion of the guide portion 71B of the projecting plate 71 is inclined relative to the top plate 12 at an angle equal to an inclination angle of the heat exchanger 20 relative to the top plate 12. Similarly, the projecting plate 72 is formed so that, when the first reducing portion 60 is vertically oriented, an upper edge portion of the guide portion 72B of the projecting plate 72 is inclined relative to the top plate 12 at an angle equal to the inclination angle of the heat exchanger 20 relative to the top plate 12.

Figure 7:
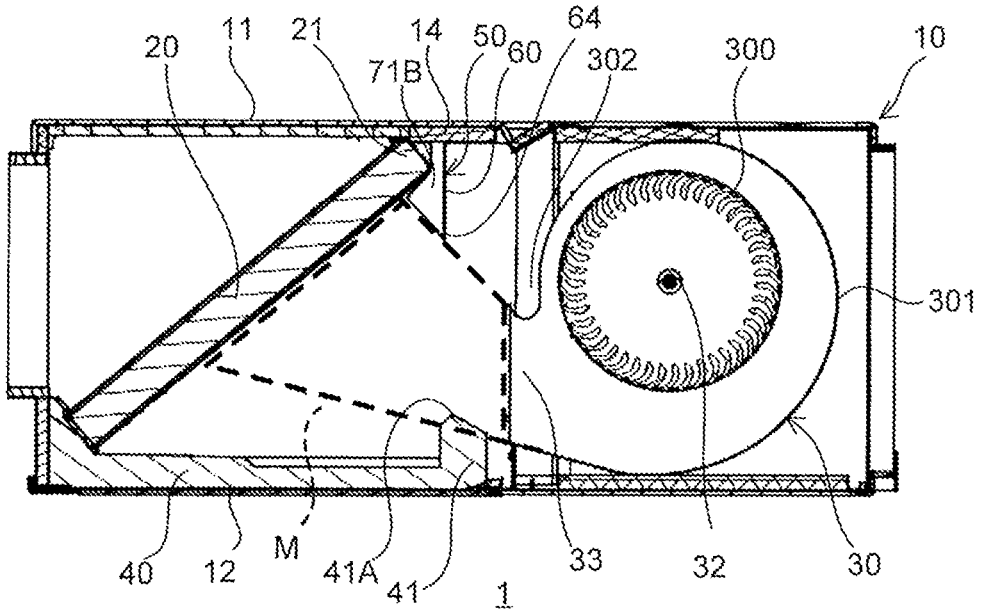
FIG. 7 is a schematic diagram illustrating a position at which the dew-scattering-reducing part according to Embodiment is disposed.
Figure 8:
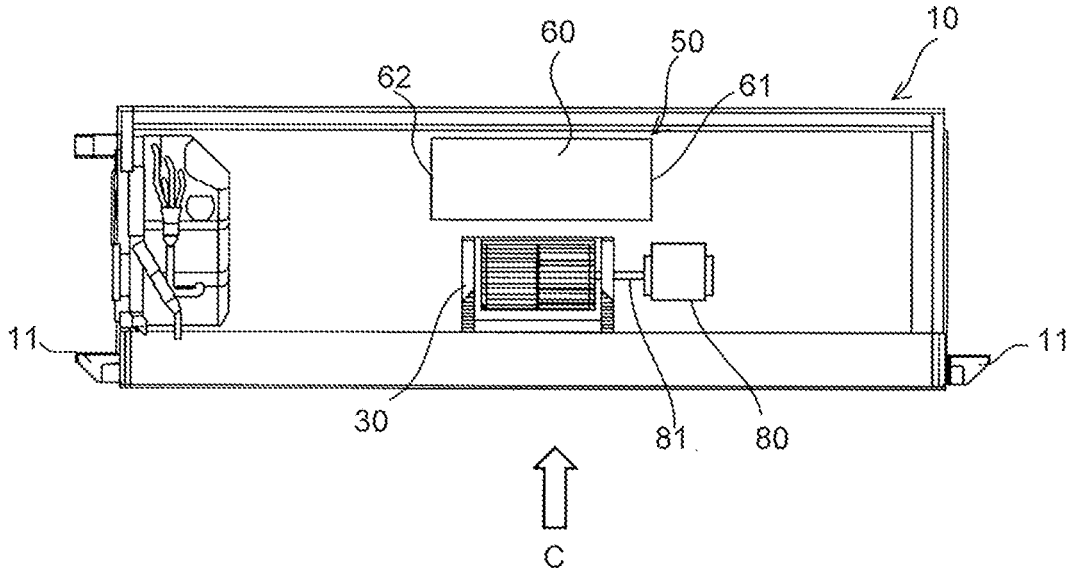
FIG. 8 is a schematic diagram illustrating the position at which the dew-scattering-reducing part according to Embodiment is disposed.
Figure 9:
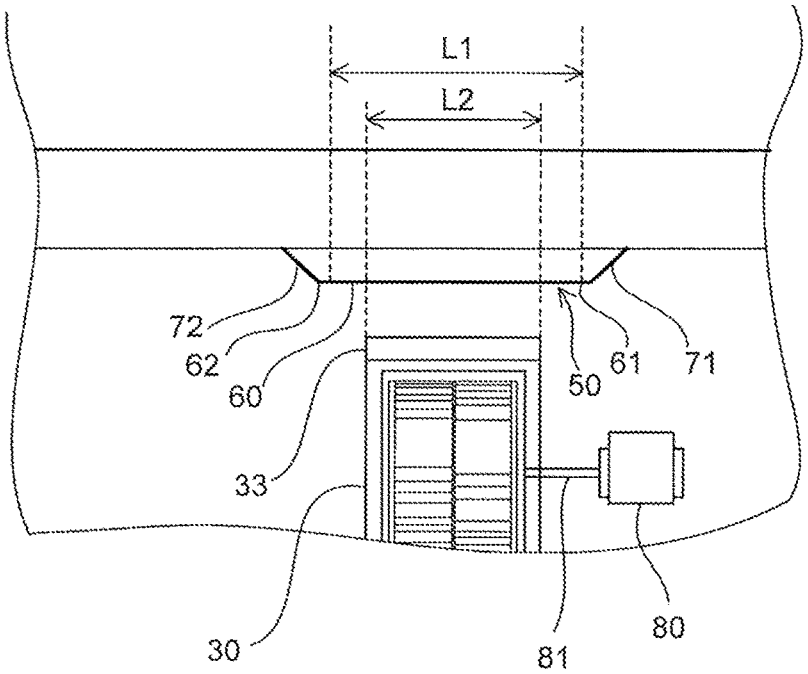
FIG. 9 is a schematic diagram illustrating the position at which the dew-scattering-reducing part according to Embodiment is disposed.

FIGS. 7 to 9 are schematic diagrams illustrating a position at which the dew-scattering-reducing part according to Embodiment is disposed. FIG. 7 schematically illustrates the internal structure of the casing 10 viewed in the direction of arrow A in FIG. 2. FIG. 8 schematically illustrates the internal structure of the casing 10 viewed in the direction of arrow B in FIG. 2. The heat exchanger 20 is not illustrated in FIG. 8. FIG. 9 schematically illustrates the internal structure of the casing 10 viewed in the direction of arrow C in FIG. 8.

As illustrated in FIGS. 8 and 9, a drive motor 80 is connected to the sirocco fan 30. The drive motor 80 includes a motor shaft 81 that is inserted in the shaft hole 32 in the sirocco fan 30 illustrated in FIG. 2. When the drive motor 80 is driven, rotation thereof is transmitted to the sirocco fan 30 through the motor shaft 81.

A region M shown by the dashed lines in FIG. 7 will now be described. The region M is a region enclosed by extension lines from the air outlet 33 toward the heat exchanger 20 along the flow of air blown from the air outlet 33 toward the heat exchanger 20. This region is determined by the shape and orientation of the air outlet 33. As illustrated in FIG. 7, in Embodiment, an upper portion and a lower portion of the air outlet 33 are inclined upward toward the heat exchanger 20. The inclination angle of the upper portion is greater than the inclination angle of the lower portion. This is because, in Embodiment, the sirocco fan 30 is disposed such that a tongue portion 302 of a fan casing 301 that houses an impeller 300 is disposed in an upper region, that is, adjacent to the top plate 12 of the casing 10. The extension lines from the air outlet 33 toward the heat exchanger 20 are determined by the angles of inner surfaces of the air outlet 33 that defines an opening, and these angles are determined by the shape from the fan casing 301 to the opening of the air outlet 33. Thus, in Embodiment, the region M is determined by the shape and orientation of the air outlet 33.

As illustrated in FIG. 7, the dew-scattering-reducing part 50 is fixed to a heat insulating material 14 provided on the top plate 12 of the casing 10. The dew-scattering-reducing part 50 is disposed outside the above-described region M. The dew-scattering-reducing part 50 is disposed so that the projecting plate 71 and the projecting plate 72 of the second reducing portion 70 face the heat exchanger 20. In other words, the projecting plate 71 and the projecting plate 72 extend toward the heat exchanger 20 relative to the first reducing portion 60. The dew-scattering-reducing part 50 is disposed between an end portion 21 of the heat exchanger 20 and the sirocco fan 30. The end portion 21 is one of end portions of the heat exchanger 20 that is adjacent to the sirocco fan 30, that is, closest to the air outlet 33.

The first reducing portion 60 is disposed such that the short-side direction thereof is parallel to the vertical direction of the casing 10, and the lower end portion 64 thereof extends to the region M. In Embodiment, the vertical distance from the position at which the dew-scattering-reducing part 50 is fixed to the heat insulating material 14 to the lower end portion 64 of the first reducing portion 60 is 80 mm to 100 mm.

A lower edge portion of the guide portion 71B of the projecting plate 71 extends to the region M. A lower edge portion of the guide portion 72B of the projecting plate 72 also extends to the region M. In other words, the guide portion 71B and the guide portion 72B are inclined toward the sirocco fan 30 along the region M.

Since the dew-scattering-reducing part 50 is disposed outside the region M, the flow of air blown from the air outlet 33 toward the heat exchanger 20 is not blocked by the dew-scattering-reducing part 50. Therefore, when the dew-scattering-reducing part 50 is disposed as in Embodiment, the heat exchange efficiency of the heat exchanger 20 is not affected, and shaft power of the drive motor 80 does not need to be increased.

The first reducing portion 60 is positioned inside the drain pan 40. In other words, in plan view of the first reducing portion 60 viewed from the top plate 12, the first reducing portion 60 is positioned inward from an edge portion 41 of the drain pan 40, which is one of edge portions of the drain pan 40 that is closest to the sirocco fan 30. More specifically, the first reducing portion 60 is positioned inward from an apex 41A of the edge portion 41 of the drain pan 40. In other words, the first reducing portion 60 is positioned further away from the sirocco fan 30 than a portion of the edge portion 41 that is closest to the top plate 12 of the casing 10.

As illustrated in FIGS. 8 and 9, the dew-scattering-reducing part 50 is disposed so that the longitudinal direction of the first reducing portion 60 is parallel to the motor shaft 81 of the drive motor 80, that is, parallel to the rotational axis of the sirocco fan 30.

As illustrated in FIG. 9, a length L1 of the first reducing portion 60 in the longitudinal direction is greater than a length L2 of the air outlet 33 in a direction parallel to the rotational axis of the sirocco fan 30. In Embodiment, L1 is greater than L2 by a factor of 1.5. Here, L1 may instead be greater than L2 by a factor of more than 1.5. The first reducing portion 60 is disposed so that both end portions of the first reducing portion 60 in the longitudinal direction, that is, the end portion 61 and the end portion 62, are positioned outside the air outlet 33.

Figure 10:
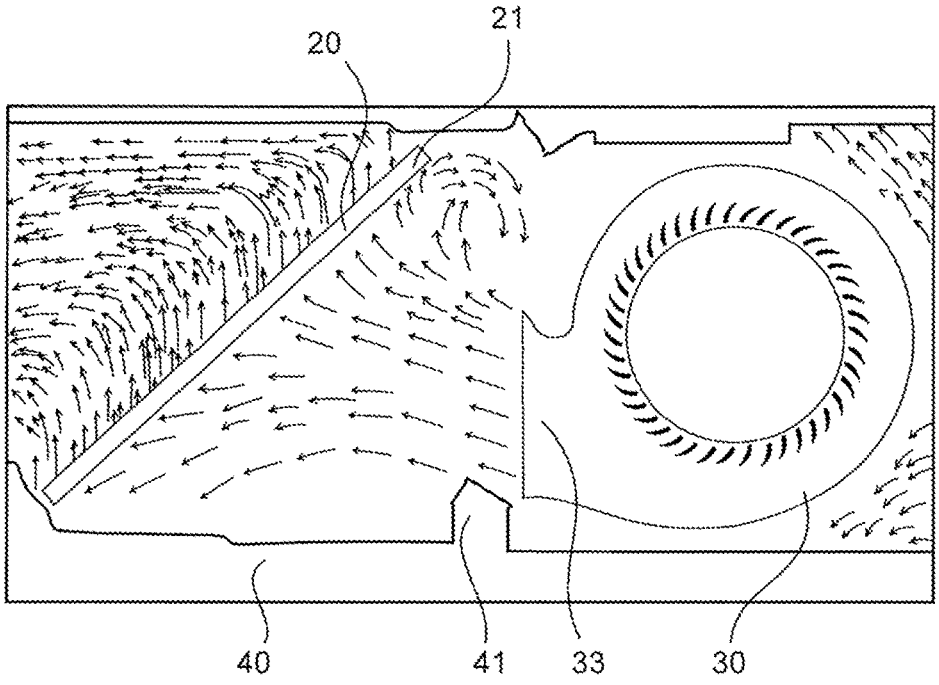
FIG. 10 is a conceptual diagram illustrating the flow of air between a sirocco fan and a heat exchanger when the dew-scattering-reducing part according to Embodiment is not provided.
Figure 11:
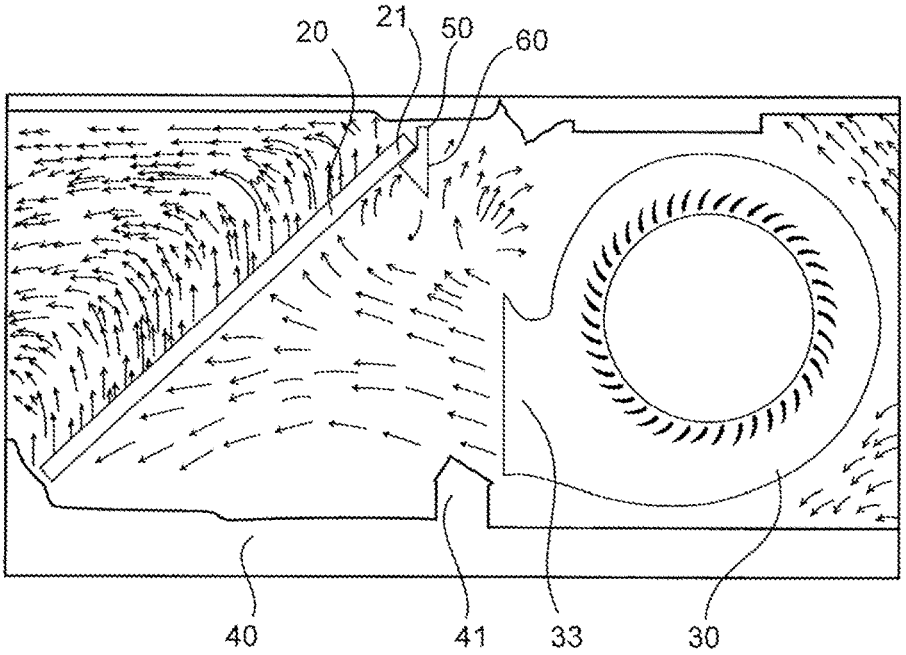
FIG. 11 is a conceptual diagram illustrating the flow of air between the sirocco fan and the heat exchanger when the dew-scattering-reducing part according to Embodiment is provided.

The effect of reducing dew scattering provided by the dew-scattering-reducing part 50 will now be described. FIG. 10 is a conceptual diagram illustrating the flow of air between the sirocco fan 30 and the heat exchanger 20 when the dew-scattering-reducing part 50 according to Embodiment is not provided. FIG. 11 is a conceptual diagram illustrating the flow of air between the sirocco fan 30 and the heat exchanger 20 when the dew-scattering-reducing part 50 according to Embodiment is provided. FIGS. 10 and 11 each illustrate the flow of air in a central region of the first reducing portion 60 of the dew-scattering-reducing part 50 in the longitudinal direction. A portion of the air blown from the air outlet 33 of the sirocco fan 30 passes through the heat exchanger 20, and the remaining portion is reflected by the heat exchanger 20. As illustrated in FIG. 10, when the dew-scattering-reducing part 50 is not provided, the air reflected by the end portion 21 of the heat exchanger 20 is guided toward the sirocco fan 30. Accordingly, a flow of air from the end portion 21 of the heat exchanger 20 toward the sirocco fan 30 is generated. The drain water generated in the heat exchanger 20 is guided and dispersed by this flow. As a result, dew scattering occurs, and the drain water is scattered beyond the edge portion 41 of the drain pan 40 toward the region outside the drain pan 40.

The dew-scattering-reducing part 50 according to Embodiment is structured such that the longitudinal direction of the first reducing portion 60 is parallel to the rotational axis of the sirocco fan 30 and that the length of the first reducing portion 60 in the longitudinal direction is 1.5 times the length of the air outlet 33 in the direction parallel to the rotational axis of the sirocco fan 30. Therefore, as illustrated in FIG. 11, the air blown from the air outlet 33 and reflected by the end portion 21 of the heat exchanger 20 is blocked by the first reducing portion 60 of the dew-scattering-reducing part 50, and is not guided toward the sirocco fan 30. Thus, the flow of air from the end portion 21 of the heat exchanger 20 toward the sirocco fan 30 is not easily generated. As a result, dispersion of the drain water generated in the heat exchanger 20 toward the sirocco fan 30 is reduced. As a result, dew scattering is reduced, and the drain water is not easily scattered toward the region outside the drain pan 40.

The air reflected by the heat exchanger 20 and blocked by the first reducing portion 60 flows along the surface of the first reducing portion 60 and is guided toward the bottom plate 13 of the casing 10. Thus, a flow of air from the heat exchanger 20, along the first reducing portion 60, and toward the bottom plate 13 is generated. The drain water generated in the heat exchanger 20 is guided by this flow, and droplets thereof fall toward the bottom plate 13. In Embodiment, the first reducing portion 60 is positioned inside the drain pan 40. Accordingly, as illustrated in FIG. 11, the drain water droplets that fall toward the bottom plate 13 are not easily scattered to the region outside the drain pan 40.

In addition, the first reducing portion 60 is positioned further away from the sirocco fan 30 than the apex 41A of the edge portion 41 of the drain pan 40. Therefore, scattering of the drain water droplets toward the region outside the drain pan 40 that fall toward the bottom plate 13 are effectively suppressed.

Figure 12:
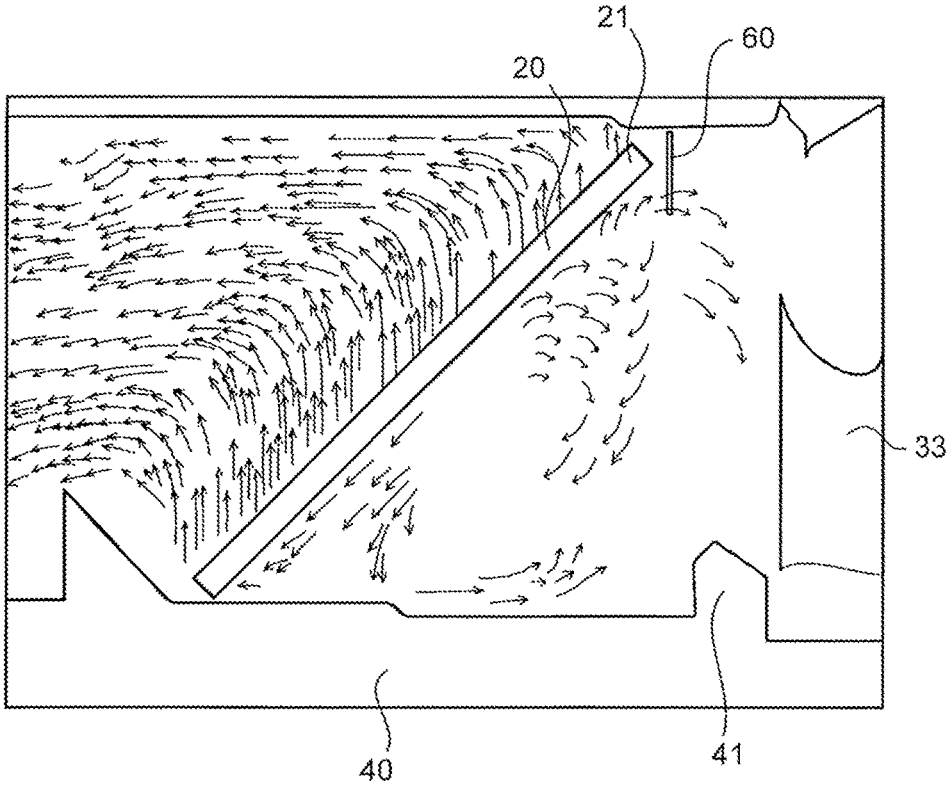
FIG. 12 is a conceptual diagram illustrating the flow of air between the sirocco fan and the heat exchanger when the dew-scattering-reducing part does not include a second reducing portion.
Figure 13:
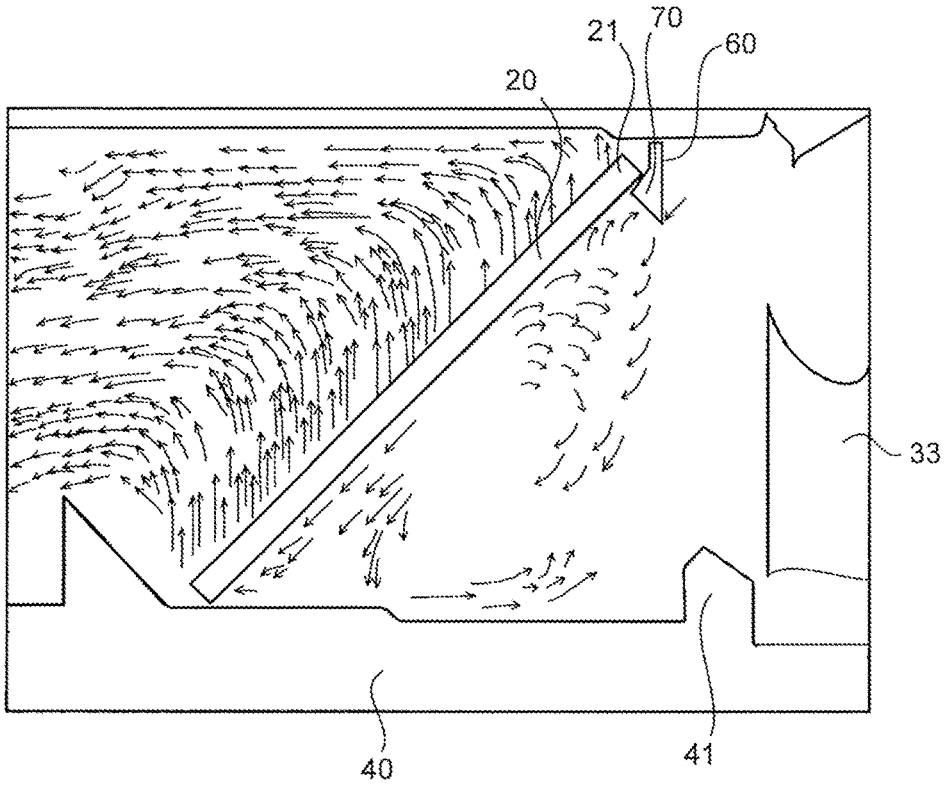
FIG. 13 is a conceptual diagram illustrating the flow of air between the sirocco fan and the heat exchanger when the dew-scattering-reducing part includes the second reducing portion.
Figure 14:
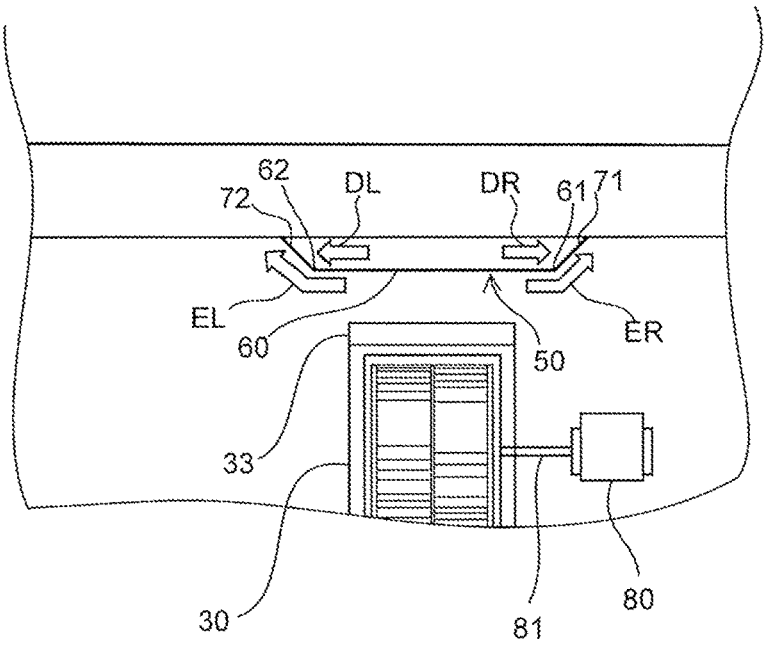
FIG. 14 is a schematic diagram illustrating the position at which the dew-scattering-reducing part according to Embodiment is disposed.

FIG. 12 is a conceptual diagram illustrating the flow of air between the sirocco fan 30 and the heat exchanger 20 when the dew-scattering-reducing part 50 does not include the second reducing portion 70. FIG. 13 is a conceptual diagram illustrating the flow of air between the sirocco fan 30 and the heat exchanger 20 when the dew-scattering-reducing part 50 includes the second reducing portion 70. FIGS. 12 and 13 each illustrate the flow of air in a region around the end portion 61 of the first reducing portion 60. FIG. 14 is a schematic diagram illustrating the position at which the dew-scattering-reducing part according to Embodiment is disposed. Similar to FIG. 9, FIG. 14 illustrates the internal structure of the casing 10 viewed in the direction of arrow C in FIG. 8. Effects of the second reducing portion 70 will be described with reference to FIGS. 12 to 14.

The air reflected by the heat exchanger 20, guided by the dew-scattering-reducing part 50, and blocked by the first reducing portion 60 flows laterally along the surface of the first reducing portion 60 that faces the heat exchanger 20, as shown by blank arrows DR and DL in FIG. 14. When the second reducing portion 70 is not provided, a portion of the air that has flowed laterally along the surface of the first reducing portion 60 may flow around the end portion 61 and the end portion 62 of the first reducing portion 60 toward the sirocco fan 30. In such a case, as illustrated in FIG. 12, a portion of the air guided laterally along the first reducing portion 60 is guided toward the sirocco fan 30.

When the second reducing portion 70 is provided, as shown by blank arrows ER and EL in FIG. 14, a portion of the air blown from the air outlet 33 is guided toward the heat exchanger 20 by the surfaces of the projecting plate 71 and the projecting plate 72 of the second reducing portion 70 that face the sirocco fan 30. Therefore, as illustrated in FIG. 13, the air guided laterally by the first reducing portion 60 does not easily flow toward the sirocco fan 30. Thus, the projecting plate 71 and the projecting plate 72 of the second reducing portion 70 function as air guides that guide the flow of air toward the heat exchanger 20.

The second reducing portion 70 also has the following effects. An air-conditioning apparatus that is installed in a ceiling, as is the air-conditioning apparatus 1 of Embodiment, generally includes the sirocco fan 30 whose short-side width, which is a width in the direction parallel to the above-described rotational axis, is significantly less than the short-side width of the internal space of the casing 10, as illustrated in FIGS. 8 and 9. Therefore, the short-side width of the air outlet 33 in the sirocco fan 30 is also significantly less than the short-side width of the casing 10. Thus, the air flow from the air outlet 33 tends to spread toward the heat exchanger 20, which serves as a flow resistance. Accordingly, a portion of the drain water generated in the heat exchanger 20 is dispersed laterally by the air flow in the casing 10. However, according to Embodiment, since the projecting plate 71 and the projecting plate 72 that function as air guides are provided as described above, laterally dispersion of the drain water is reduced. Therefore, the drain water is not easily scattered toward the region outside the drain pan 40, and leakage thereof to the outside of the air-conditioning apparatus 1 through a clearance in the casing 10 can be suppressed.

As described above, according to Embodiment, the occurrence of dew scattering, which is dispersion of drain water generated in the heat exchanger 20, can be reduced without causing an increase in the shaft power of the drive motor 80 of the sirocco fan 30.

In addition, according to Embodiment, since the dew-scattering-reducing part 50 is provided, scattering of the drain water to the sirocco fan 30 can be reduced without increasing the distance between the heat exchanger 20 and the sirocco fan 30. Thus, dew scattering can be reduced without increasing the size of the air-conditioning apparatus 1.

Although the projecting plate 71 and the projecting plate 72 of the second reducing portion 70 are integrated with the first reducing portion 60 in Embodiment, the projecting plate 71 and the projecting plate 72 are not limited to this. The projecting plate 71 and the projecting plate 72 may instead be formed as components separate from the first reducing portion 60. In such a case, the projecting plate 71 and the projecting plate 72 may, for example, be fixed between fins of the heat exchanger 20.

Although the first reducing portion 60 and each of the projecting plate 71 and the projecting plate 72 of the second reducing portion 70 are made of a metal material in Embodiment, the material thereof is not limited to this. For example, these parts may instead be molded from a resin.

Although the first reducing portion 60 and the second reducing portion 70 are plate-shaped parts with no irregularities in Embodiment, the first reducing portion 60 and the second reducing portion 70 are not limited to this. The first reducing portion 60 and the second reducing portion 70 may instead have a wavy shape. For example, the first reducing portion 60 and the second reducing portion 70 may be formed such that ridges and furrows are arranged continuously and alternately in the vertical direction or such that ridges and furrows are arranged continuously and alternately in a horizontal direction.

When the first reducing portion 60 and the second reducing portion 70 are formed such that ridges and furrows are arranged continuously and alternately in the vertical direction, the drain water can be guided in horizontal directions. The drain water guided in the horizontal directions drips from the left and right end portions of the second reducing portion 70. When the first reducing portion 60 and the second reducing portion 70 are formed such that ridges and furrows are arranged continuously and alternately in a horizontal direction, the drain water can be guided downward. Thus, when the first reducing portion 60 and the second reducing portion 70 are formed in a wavy shape, the furrows of the wavy shape function as water guide grooves or drainage grooves. Also when the first reducing portion 60 and the second reducing portion 70 are formed in a wavy shape for design purposes other than the purpose of suppressing dew scattering, the furrows of the wavy shape function as water guide grooves or drainage grooves for the drain water.

The first reducing portion 60 may have projections on at least one of the surface thereof that faces the heat exchanger 20 and the surface thereof that faces the sirocco fan 30. Similarly, each of the projecting plate 71 and the projecting plate 72 of the second reducing portion 70 may have projections on at least one of the surface thereof that faces the heat exchanger 20 and the surface thereof that faces the sirocco fan 30.

When the projections are provided, the drain water can be more easily removed from the surfaces of the first reducing portion 60, the projecting plate 71, and the projecting plate 72. Also when the projections are provided for design purposes other than the purpose of suppressing dew scattering, the drain water can be more easily removed.

Each of the first reducing portion 60, the projecting plate 71, and the projecting plate 72 may have grooves that extend in the vertical direction in the surface thereof that faces the heat exchanger 20, so that the drain water is guided toward the drain pan 40. When such grooves are formed, the drain water can be more reliably guided toward the drain pan 40.

REFERENCE SIGNS LIST

1: air-conditioning apparatus, 10: casing, 11: hanging metal piece, 12: top plate, 13: bottom plate, 14: heat insulating material, 20: heat exchanger, 21: end portion, 30: sirocco fan, 32: shaft hole, 33: air outlet, 40: drain pan, 41: edge portion, 41A: apex, 50: dew-scattering-reducing part, 60: first reducing portion, 61: end portion, 62: end portion, 63: upper end portion, 64: lower end portion, 70: second reducing portion, 71: projecting plate, 71A: base portion, 71B: guide portion, 72: projecting plate, 72A: base portion, 72B: guide portion, 80: drive motor, 81: motor shaft, 300: impeller, 301: fan casing, 302: tongue portion, M: region, α: angle, β; angle

The invention claimed is:

1. An air-conditioning apparatus comprising:

a casing;

a heat exchanger disposed in the casing;

a sirocco fan disposed in the casing and located upstream of the heat exchanger along a flow passage such that an air outlet of the sirocco fan faces the heat exchanger;

a drain pan disposed in the casing and located below the heat exchanger to receive drain water generated in the heat exchanger, the drain pan including an edge portion that is located closest to the sirocco fan; and a dew-scattering-reducing part that reduces scattering of the drain water, the dew-scattering-reducing part comprising a first reducing portion that is an elongated plate-shaped part, wherein the dew-scattering-reducing part is disposed outside a region enclosed by extension lines from the air outlet toward the heat exchanger and is positioned between an end portion of the heat exchanger that is adjacent to the sirocco fan and the sirocco fan such that the first reducing portion is located downstream of the edge portion of the drain pan that is located closest to the sirocco fan.

2. The air-conditioning apparatus of claim 1, wherein a length of the first reducing portion in a longitudinal direction is greater than a length of the air outlet in a direction parallel to a rotational axis of the sirocco fan, and wherein the longitudinal direction of the first reducing portion is parallel to the rotational axis, and both end portions of the first reducing portion in the longitudinal direction are positioned outside the air outlet.

3. The air-conditioning apparatus of claim 2, wherein the first reducing portion is disposed such that a short-side direction thereof is parallel to a vertical direction of the casing, and a lower end portion of the first reducing portion extends to the region.

4. The air-conditioning apparatus of claim 3, wherein the lower end portion of the first reducing portion is positioned further away from the sirocco fan than a portion of the edge portion of the drain pan that is closest to the sirocco fan, the portion being closest to a top plate of the casing.

5. The air-conditioning apparatus of claim 2, wherein the dew-scattering-reducing part includes a second reducing portion for guiding air blown from the air outlet toward the heat exchanger.

6. The air-conditioning apparatus of claim 5, wherein the second reducing portion comprises a plate-shaped part that extends in a direction toward the heat exchanger relative to the first reducing portion.

7. The air-conditioning apparatus of claim 5, wherein the second reducing portion is formed to be continuous with both end portions of the first reducing portion in the longitudinal direction.

8. The air-conditioning apparatus of claim 5, wherein an edge portion of the second reducing portion that faces a bottom plate of the casing extends to the region.

9. The air-conditioning apparatus of claim 1, wherein the heat exchanger is inclined in a direction from a top plate of the casing toward a bottom plate of the casing with increasing distance from the sirocco fan, and the dew-scattering-reducing part is provided on the top plate of the casing.

* * * * *